US005376032A

United States Patent [19]

Meisenburg et al.

[11] Patent Number: 5,376,032

[45] Date of Patent: Dec. 27, 1994

[54] MARINE DRIVE WITH SKEG WATER INLET

[75] Inventors: Gary L. Meisenburg; Phillip D. Magee; John W. Behara, all of Stillwater, Okla.

[73] Assignee: Brunswick Corporation, Lake Forest, Ill.

[21] Appl. No.: 84,877

[22] Filed: Jun. 30, 1993

Related U.S. Application Data

[63] Continuation-in-part of Ser. No. 889,495, May 27, 1992, Pat. No. 5,230,644, and Ser. No. 889,530, May 27, 1992, Pat. No. 5,249,995.

[51] Int. Cl.[5] ..... B63H 21/10

[52] U.S. Cl. ..... 440/88; 440/81

[58] Field of Search ..... 440/66, 75-83, 440/900, 88, 89; 123/195 P

[56] References Cited

U.S. PATENT DOCUMENTS

| | | | |
|---|---|---|---|
| 2,847,967 | 8/1958 | Kiekhaefer | 440/88 |
| 3,164,121 | 1/1965 | Alexander, Jr. | 440/88 |
| 3,952,686 | 4/1976 | Pichl | 115/117 |
| 4,630,719 | 12/1986 | McCormick | 192/21 |
| 4,679,682 | 7/1987 | Gray, Jr. et al. | 192/21 |
| 4,764,135 | 8/1988 | McCormick | 440/83 |
| 4,790,782 | 12/1988 | McCormick | 440/61 |
| 4,792,315 | 12/1988 | Karrasch et al. | 440/83 |
| 4,795,382 | 1/1989 | McCormick | 440/81 |
| 4,832,635 | 5/1989 | McCormick | 440/78 |
| 4,832,636 | 5/1989 | McCormick | 440/80 |
| 4,861,293 | 8/1989 | McGowan et al. | 440/76 |
| 4,863,406 | 9/1989 | Bland et al. | 440/83 |
| 4,869,121 | 9/1989 | Meisenburg | 440/80 |
| 4,869,694 | 9/1989 | McCormick | 440/83 |
| 4,871,334 | 10/1989 | McCormick | 440/89 |
| 4,897,058 | 1/1990 | McCormick | 440/80 |
| 4,900,281 | 2/1990 | McCormick | 440/78 |
| 4,993,848 | 2/1991 | John et al. | 440/78 |

*Primary Examiner*—Edwin L. Swinehart

*Attorney, Agent, or Firm*—Andrus, Sceales, Starke & Sawall

[57] ABSTRACT

A marine drive (10) has a water inlet (234) on the side of the skeg (194). One or more turning vanes (261, 289) receive incoming water flow and turn and direct same forwardly and upwardly within the skeg to a torpedo nose passage (198). A flow divider (284, 285) separates incoming water flow entering the water inlet opening into upper and lower water streams each initially flowing along a first path horizontally rearwardly and then along a second curved path and then merging along a third path upwardly and forwardly in an internal water passage (196) in the skeg. Water inlet plate structure maintains desired water intake flow volume.

25 Claims, 7 Drawing Sheets

FIG. 7
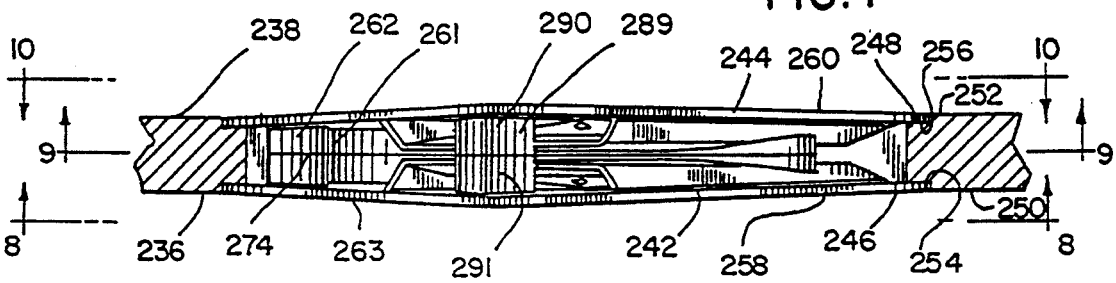
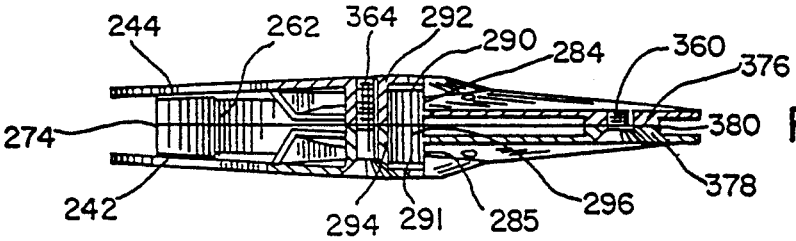
FIG. 11
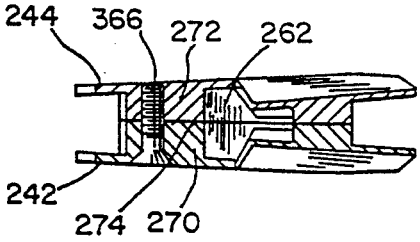
FIG. 12
FIG. 13
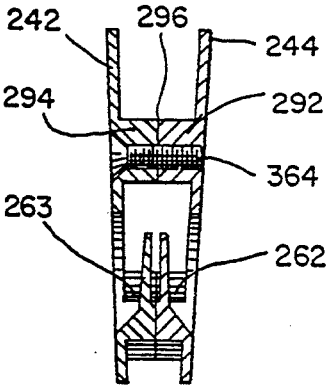
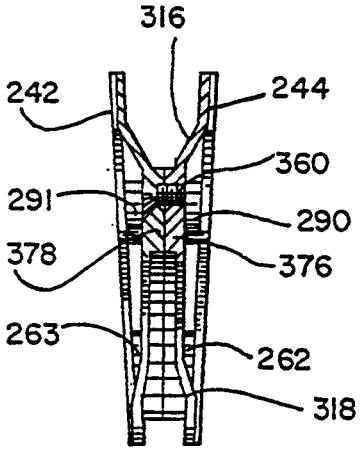
FIG. 14

MARINE DRIVE WITH SKEG WATER INLET

CROSS REFERENCE TO RELATED APPLICATIONS

This application is a continuation-in-part of allowed U.S. application Ser. No. 07/889,495, filed May 27, 1992, now U.S. Pat. No. 5,230,644 and allowed U.S. application Ser. No. 07/889,530, filed May 27, 1992, now U.S. Pat. No. 5,249,995 incorporated herein by reference.

BACKGROUND AND SUMMARY

The invention relates to a marine drive, and more particularly to water inlet structure in the skeg for providing cooling water for the marine drive.

The invention arose during development efforts directed toward a surfacing marine drive enabling increased top end boat speed, though the invention is not limited thereto. Surfacing drives for eliminating torpedo drag are known in the art, for example U.S. Pat. No. 4,871,334, column 3, lines 35+.

Cooling water inlets for a marine drive are typically provided in the drive housing above the torpedo. In a surfacing drive, when the torpedo is raised completely or partially above the water surface, the cooling water inlets must be relocated to a lower position which will remain below the water surface. It is known in the prior art to provide a cooling water inlet in the skeg below the torpedo, U.S. Pat. No. 3,164,121, column 2, lines 52+.

The present invention provides improved water inlet structure and function in the skeg.

BRIEF DESCRIPTION OF THE DRAWINGS

FIG. 7 is a top sectional view taken along line 7—7 of FIG. 5.

FIG. 11 is a sectional view taken along line 11—11 of FIG. 8.

FIG. 12 is a sectional view taken along line 12—12 of FIG. 8.

FIG. 13 is a sectional view taken along line 13—13 of FIG. 8.

FIG. 14 is a sectional view taken along line 14—14 of FIG. 8.

DETAILED DESCRIPTION

Figure 1:
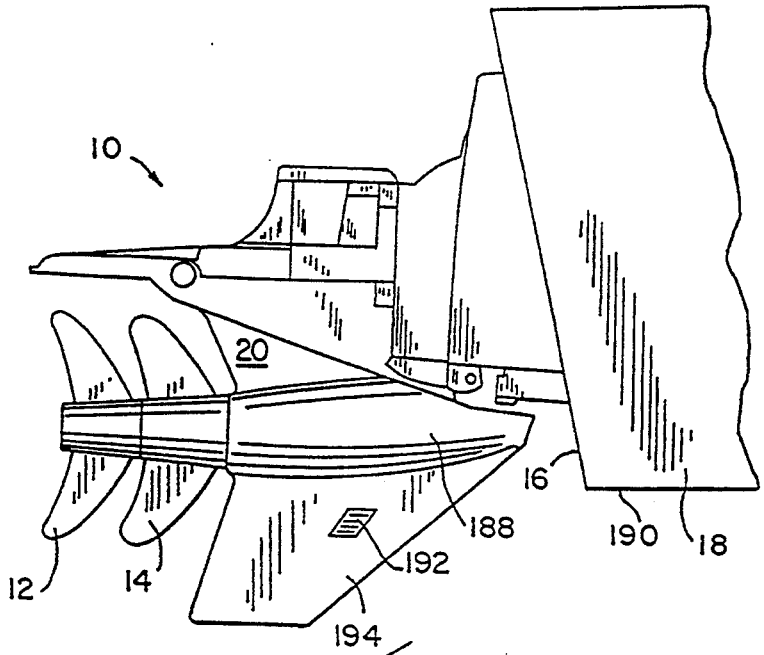
FIG. 1 is a side elevation view of a marine drive in accordance with the invention.

FIG. 1 shows a marine drive 10 having two counter-rotating surface operating propellers 12 and 14. The drive is mounted to the transom 16 of a boat 18 in the usual manner for a stern drive. The drive includes a housing 20, FIG. 2, having upper and lower spaced horizontal bores 22 and 24, and an intersecting vertical bore 26 extending therebetween. An upper input shaft 28 is in upper horizontal bore 22 and is coupled through a universal joint 30 to an input shaft 32 driven by the engine (not shown) in the boat. The universal joint enables trimming and steering of the drive. The input shaft drives an upper gear assembly 34 which is known in the art, for example as shown in U.S. Pat. Nos. 4,630,719, 4,679,682, and 4,869,121, incorporated herein by reference. A downwardly extending driveshaft 36 in vertical bore 26 is driven by input shaft 28 through upper gear assembly 34 operatively connected therebetween. Input gear 38 on shaft 28 rotates about a horizontal axis and drives gears 40 and 42 to rotate in opposite directions about a vertical axis. Shift and clutch assembly 44 causes engagement of one or the other of gears 40 and 42, to in turn cause rotation of driveshaft 36 in one or the other direction, to provide forward or reverse operation, all as in the noted incorporated patents.

Figure 3:
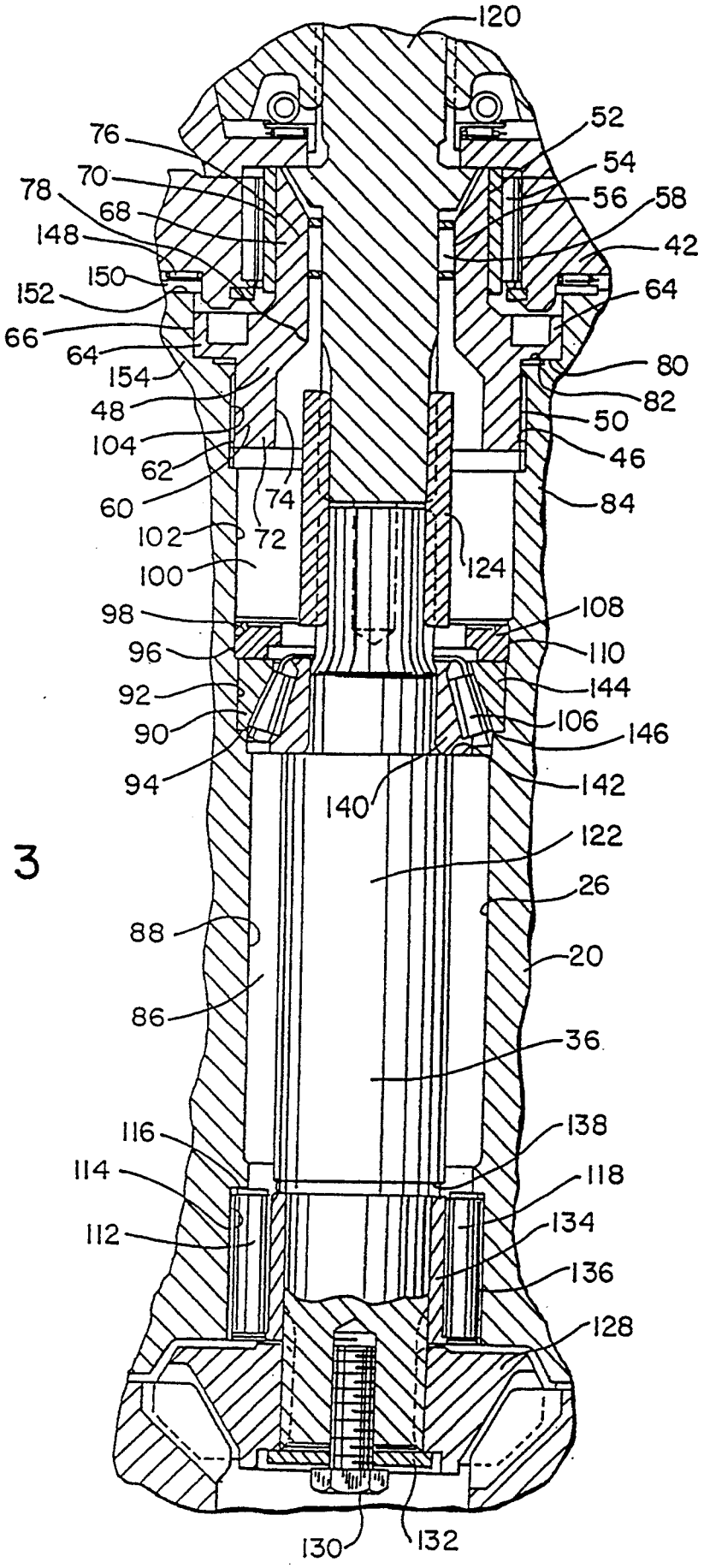
FIG. 3 is an enlarged view of a portion of the structure of FIG. 2.

Vertical bore 26 has an upper threaded portion 46, FIG. 3. An upper adaptor spool 48 has a lower threaded outer portion 50 mating with threaded portion 46 of vertical bore 26 and supporting gear 42 for rotation about driveshaft 36. Adaptor spool 48 has an upper outer surface 52 supporting an upper outer needle bearing 54 which supports gear 42 for rotation about adaptor spool 48. Adaptor spool 48 has an upper inner surface 56 supporting an upper inner needle bearing 58 which supports driveshaft 36 for rotation in adaptor spool 48.

Adaptor spool 48 has a lower outer section 60, FIG. 3, of a first outer diameter 62 and threaded as noted at 50 and mating with upper threaded portion 46 of vertical bore 26. Adaptor spool 48 has a central outer section 64 above lower outer section 60 and of a central outer diameter 66 larger than lower outer diameter 62. Adaptor spool 48 has an upper outer section 68 above central outer section 64 and of an upper outer diameter 70 less than central outer diameter 66 and less than lower outer diameter 62. Adaptor spool 48 has a lower inner section 72 of a lower inner diameter 74 within vertical bore 26. Adaptor spool 48 has an upper inner section 76 above lower inner section 72 and of an upper inner diameter 78 less than lower inner diameter 74. Upper outer needle bearing 54 is between gear 42 and upper outer section 68 of adaptor spool 48 and supports gear 42 for rotation about adaptor spool 48. Upper inner needle bearing 58 is between driveshaft 36 and upper inner section 76 of adaptor spool 48 and supports driveshaft 36 for rotation in adaptor spool 48. Lower outer section 60 and central outer section 64 of adaptor spool 48 meet at a downwardly facing annular shoulder 80 at the top end 82 of housing sidewall 84 forming vertical bore 26. Upper outer diameter 70 is substantially equal to lower inner diameter 74 of adaptor spool 48.

Figure 4:
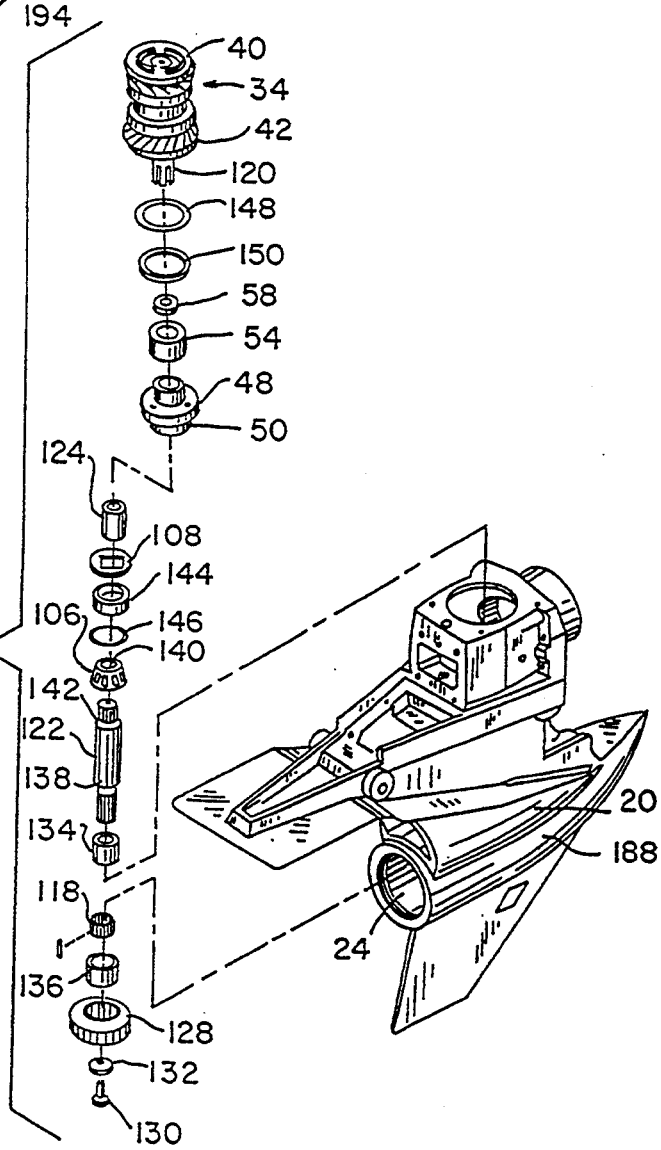
FIG. 4 is an exploded perspective view of a portion of the structure of FIG. 1.

Vertical bore 26 has a first section 86, FIG. 3, of a first inner diameter 88. Vertical bore 26 has a second section 90 above first section 86 and of a second inner diameter 92 larger than inner diameter 88. Sections 86 and 90 meet at an upwardly facing annular shoulder 94. Vertical bore 26 has a first thread 96 above second section 90 and of an inner diameter 98 at least as great as second inner diameter 92. Vertical bore 26 has a third section 100 above first thread 96 and of a third inner diameter 102 greater than second inner diameter 98. Vertical bore 26 has a second thread, provided by the noted thread 46, above third section 100 and of an inner diameter 104 at least as great as third inner diameter 102. A central tapered roller thrust bearing 106 is seated against shoulder 94 of vertical bore 26. An annular ring 108 has a threaded outer portion 110 mating with thread 96 of vertical bore 26 and retains bearing 106 against shoulder 94. Vertical bore 26 has a fourth section 112 below first section 86 and of a fourth inner diameter 114 larger than first inner diameter 88. First and fourth sections 86 and 112 meet at a downwardly facing annular shoulder 116. A lower needle bearing 118 supports driveshaft 36 for rotation. Central and upper bearings 106 and 58 are inserted into vertical bore 26 from above, FIG. 4. Lower bearing 118 is inserted into vertical bore 26 from below.

Driveshaft 36, FIG. 3, is a two piece member formed by an upper driveshaft segment 120 and a lower driveshaft segment 122 coupled by a sleeve 124 in splined relation. Central bearing 106 and lower bearing 118 support the lower driveshaft segment 122. Upper bearing 58 supports the upper driveshaft segment 120. The upper driveshaft segment is also supported by another upper needle bearing 126, FIG. 2, as in the noted incorporated patents.

Driveshaft 36 has a lower pinion gear 128, FIG. 3, mounted thereto by bolt 130 and washer 132. Needle bearing 118 is above pinion gear 128 and is supported between inner and outer races 134 and 136. Bearing 106 has an inner race 140 engaging shoulder 142 on lower driveshaft segment 122. Bearing 106 has an outer race 144 stopped against shoulder 94 in bore 26. One or more shims 146 may be provided between outer race 144 and shoulder 94 to adjust axial positioning if desired. Gear 42 rotates on bearing 148 on race 150 seated on shoulder 152 of housing sidewall 154.

Figure 2:
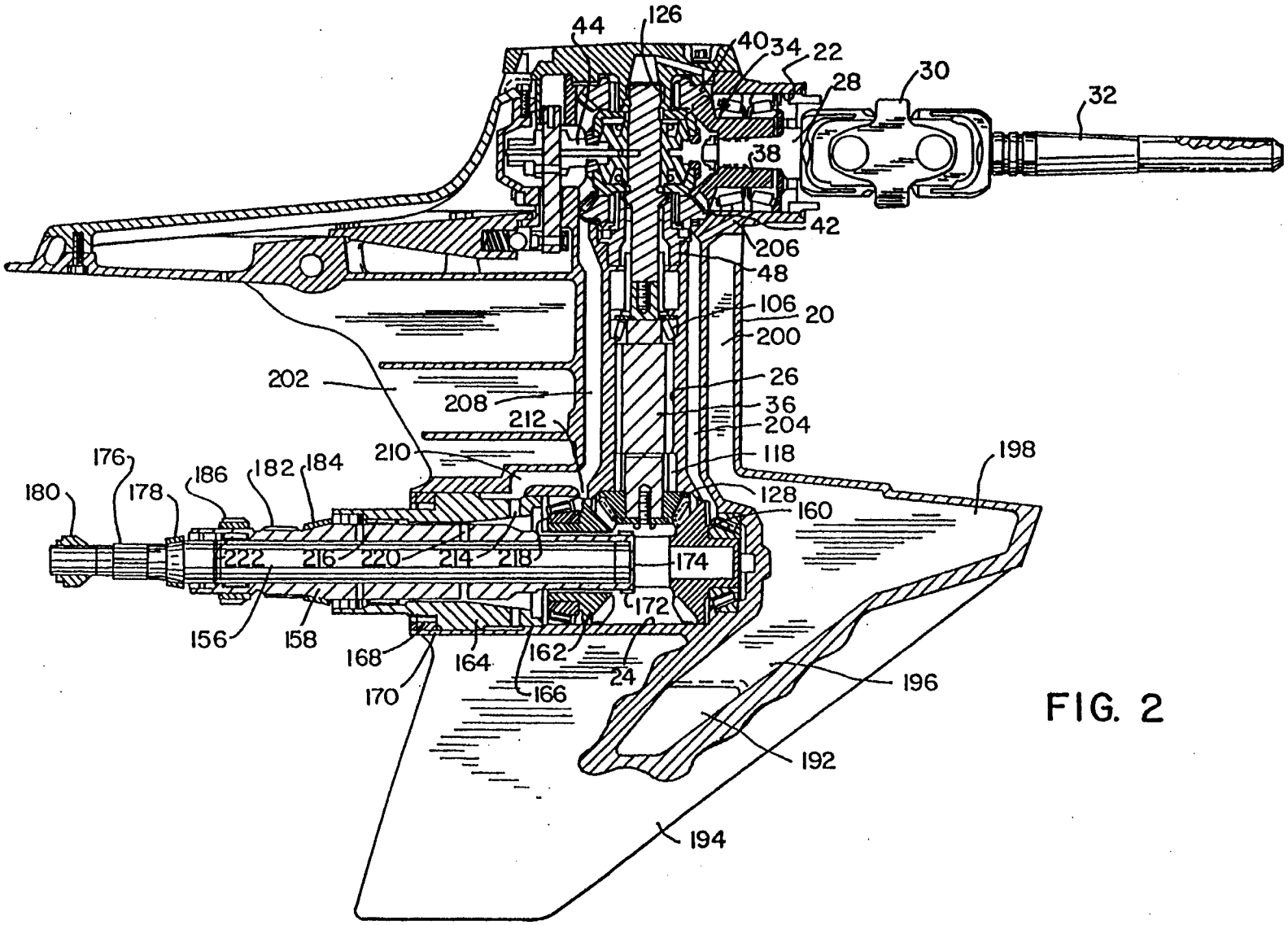
FIG. 2 is a partial sectional view of a portion of the structure of FIG. 1.

A pair of lower concentric counter-rotating inner and outer propeller shafts 156 and 158, FIG. 2, in lower horizontal bore 24 are driven by driveshaft 36. Inner propeller shaft 156 has a fore gear 160 driven by pinion gear 128 to drivingly rotate inner propeller shaft 156. Outer propeller shaft 158 has an aft gear 162 driven by pinion gear 128 to drivingly rotate outer propeller shaft 158 in the opposite rotational direction than inner propeller shaft 156. Reference is made to allowed incorporated U.S. application Ser. No. 07/889,530, filed May 27, 1992. The dual propeller shaft assembly is mounted in horizontal bore 24 by a spool assembly 164 at right hand threads 166 and retaining ring 168 having left hand threads 170. The right hand threads prevent right hand rotational loosening of the spool assembly, and the left hand threads 170 prevent left hand rotational loosening of the spool assembly. Forward thrust is transferred from the outer propeller shaft 158 to the inner propeller shaft 156 at thrust bearing 172 against annular shoulder 174 on inner propeller shaft 156. Propeller 12 is mounted on inner propeller shaft 156 in splined relation at 176 between tapered ring 178 and threaded nut 180. Propeller 14 is mounted on outer propeller shaft 158 in splined relation at 182 between tapered ring 184 and threaded nut 186.

The vertical distance between adaptor spool 48 and lower bearing 118 is about equal to the radius of propellers 12 and 14. Lower horizontal bore 24 of housing 20 is in the portion commonly called the torpedo 188, FIGS. 1 and 4. Torpedo 188 is slightly above the bottom 190 of boat 18 and hence is slightly above the surface of the water, thus reducing drag. This raising of the torpedo above the surface of the water is accomplished without a like raising of the engine in the boat nor the usual transom mounting location for the drive. In the preferred embodiment, the engine is raised 2 to 3 inches above the standard location. Housing 20 is a one-piece unitary integrally cast housing replacing prior two piece housings. Propeller shafts 156, 158 are spaced from upper input shaft 28 by a distance along driveshaft 36 in the range of about 8 to 15 inches.

Cooling water for the engine is supplied through water intake 192 in skeg 194, and flows through skeg passage 196 and then through torpedo nose passage 198 and then through housing passage 200 to the engine in the usual manner. After cooling the engine, the water and engine exhaust are exhausted in the usual manner through an exhaust elbow and exhausted through the housing and discharged at exhaust outlet 202 above torpedo 188 and into the path of the propellers in the upper portion of their rotation, as in U.S. Pat. No. 4,871,334. Oil is circulated from the lower gears upwardly through passage 204 and passage 206 to the upper gears, and returned to the lower gears at passage 208 feeding passages 210 and 212. Oil is supplied from passage 210 through spool assembly passage 214 to bearings 216 and 218, and through outer propeller shaft passage 220 to bearing 222. Passage 212 supplies oil to the front of bearing 218. Central outer section 64 of adaptor spool 48 closes off oil passage 204, to divert flow to passage 206.

Figure 5:
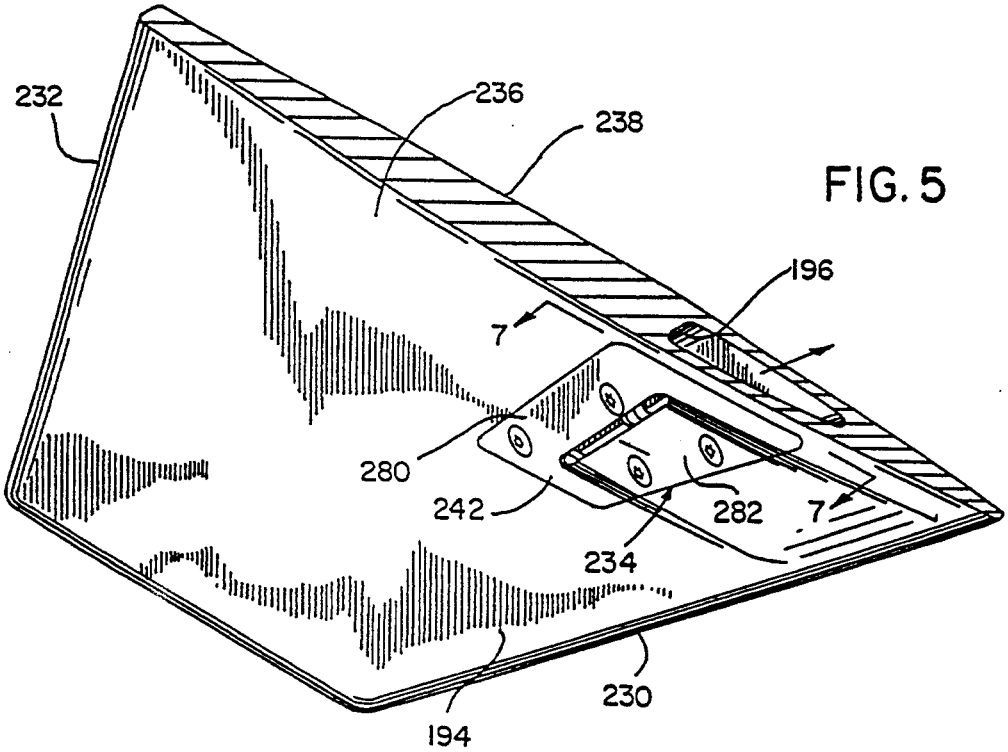
FIG. 5 is an enlarged perspective view of a portion of the structure of FIG. 1.

As above noted, marine drive 10 has a housing 20 having a lower torpedo 188 and a skeg 194 extending downwardly from the torpedo. The skeg has a forward leading edge 230, FIG. 5, a rearward trailing edge 232, and a water inlet 234 on the side of the skeg between forward leading edge 230 and rearward trailing edge 232 and supplying cooling water for the marine drive. The skeg has right and left sidewalls 236 and 238 extending from forward leading edge 230 rearwardly to rearward trailing edge 232. Water inlet opening 240, FIG. 6, extends transversely across and through skeg 194 between right and left sidewalls 236 and 238.

Skeg 194 has the noted internal water passage 196 extending from water inlet opening 240 forwardly and upwardly through the skeg to torpedo 188. Housing 20 has the noted lower horizontal bore 24 in torpedo 188, and the noted vertical bore 26 extending upwardly therefrom. Gear assembly 160, 162 is in lower horizontal bore 24 beneath vertical bore 26. Water passage 196 in skeg 194 extends forwardly and upwardly into torpedo 188 at the noted torpedo nose passage 198 forwardly of gear assembly 160, 162.

Figure 6:
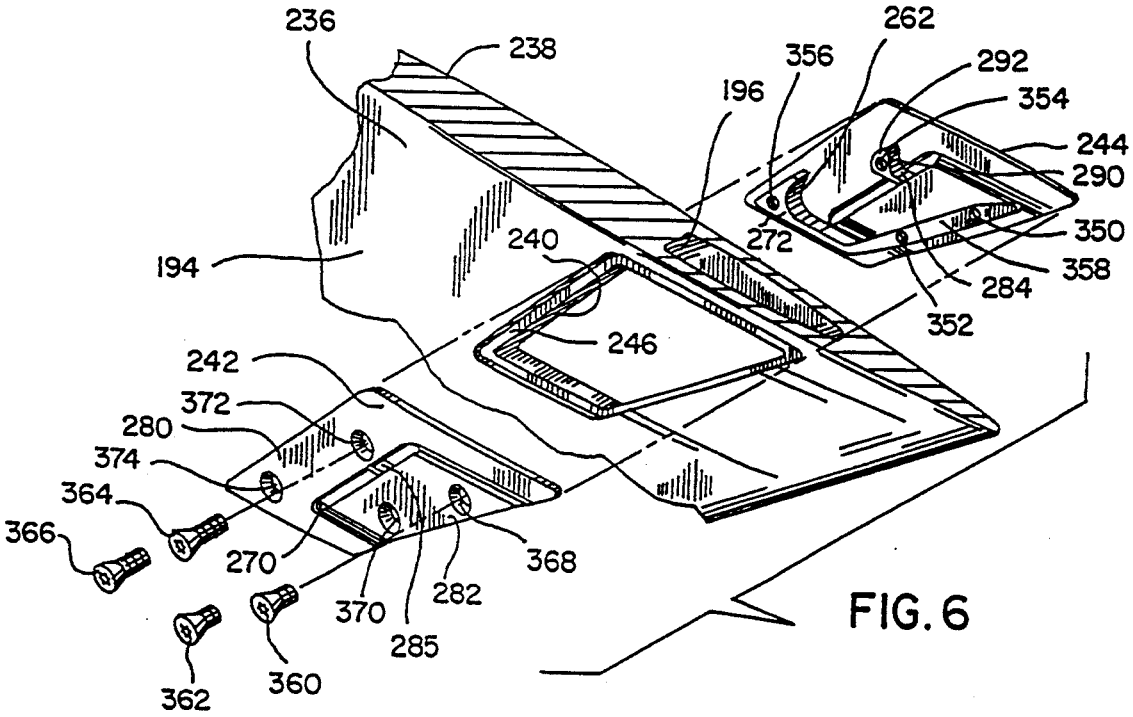
FIG. 6 is an exploded view of the structure of FIG. 5.
Figure 8:
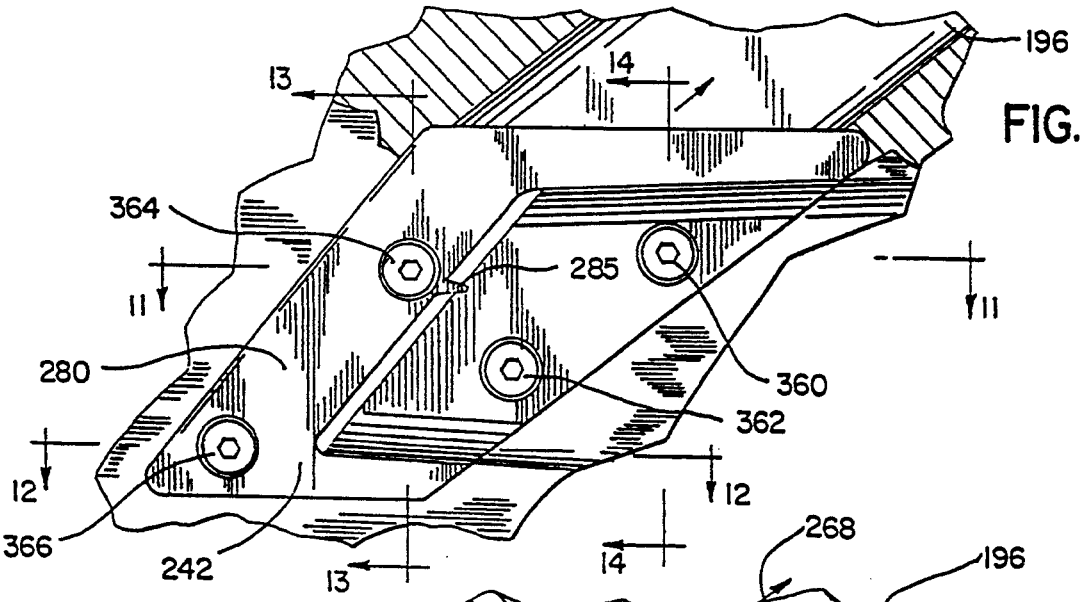
FIG. 8 is a view partly in section taken along line 8—8 of FIG. 7.

Right and left water inlet plates 242 and 244, FIG. 6, are mounted substantially flush against respective right and left sidewalls 236 and 238 at water inlet opening 240. The plates are mounted to each other, to be described. Water inlet opening 240 has right and left inner lips 246 and 248, FIGS. 6 and 7, recessed inwardly of the outer surfaces 250 and 252 of right and left sidewalls 236 and 238. Plates 242 and 244 have inner surfaces 254 and 256, FIG. 7, engaging respective lips 246 and 248 in nested relation such that outer surface 258 of plate 242 is flush with outer surface 250 of right sidewall 236, and outer surface 260 of plate 244 is flush with outer surface 252 of left sidewall 238.

A lower turning vane 261 in water inlet 234 receives incoming water flow and turns and directs same upwardly within skeg 194. Turning vane 261 is provided by a pair of abutting curved radiused surfaces 262 and 263 guiding water flow therealong with minimum turbulence. Incoming water initially flows along a first path 264 horizontally rearwardly and then flows along a second curved path 266 along turning vane 262 and then flows along a third path 268 upwardly in internal water passage 196. The change in direction of water flow from first path 264 to third path 268 is greater than 90°, and in the preferred embodiment is about 120°. Water inlet plates 242 and 244 have respective inner boss portions 270 and 272 extending into water inlet opening 240 and meeting each other in abutting relation at interface 274 and forming turning vane 261. Curved radiused surfaces 262 and 263 are formed along respective boss portions 272 and 270.

Each of water inlet plates 242 and 244 directs water flow into water inlet 234. Left plate 244 has an aft outer surface 276, FIG. 10, spaced rearwardly and outwardly of a forward ramp surface 278, FIGS. 10 and 15. Water flows along ramp surface 278 along first path 264 and inwardly of aft outer surface 276. Vane surface 262, FIGS. 6 and 9, intercepts water flow from ramp surface 278 along first path 264 and provides the noted second curved path 266. Right water inlet plate 242 is comparable, and has aft outer surface 280, forward ramp surface 282, and inwardly extending boss portion 270 providing turning vane surface 263.

Water inlet plates 242 and 244 cover water inlet opening 240. The plates have respective flow dividers 284, 285, FIG. 6, separating incoming water flow entering water inlet opening 240 into separate upper and lower water streams 286 and 264, FIGS. 9 and 10 each initially flowing along a first respective path horizontally rearwardly and then along a second respective curved path 288, 266 and then along a merged third path 268 upwardly in internal water passage 196. An upper turning vane 289 receives incoming water flow along path 286 and directs same upwardly within skeg 194. Turning vane 289, FIG. 7, is provided by a pair of abutting curved radiused surfaces 290 and 291 guiding water flow therealong with minimum turbulence. Incoming water initially flows along path 286 horizontally rearwardly and then flows along curved path 288 along the upper turning vane and then flows along path 268 upwardly in internal water passage 196. The change in direction of water flow from path 286 to path 268 is preferably about 120°. Water inlet plates 244 and 242 have respective inner boss portions 292 and 294 extending into water inlet opening 240 and meeting each other in abutting relation at interface 296 and forming upper turning vane 289. Curved radiused turning vane surfaces 290 and 291 are formed along respective boss portions 292 and 294. Turning vane surfaces 290 and 291 have respective forward leading edges 284 and 286 providing the noted flow divider.

Upper turning vane 289 is spaced from lower turning vane 261 along the direction of the noted third water flow path 268. The lower water stream flows along second curved path 266 along lower turning vane surfaces 262, 263 and then flows upwardly along the third path aft of upper turning vane 289 at bosses 292, 294 and then merges with the upper water stream flowing along path 288 to form a merged water stream at 268 above upper turning vane 289.

Figure 10:
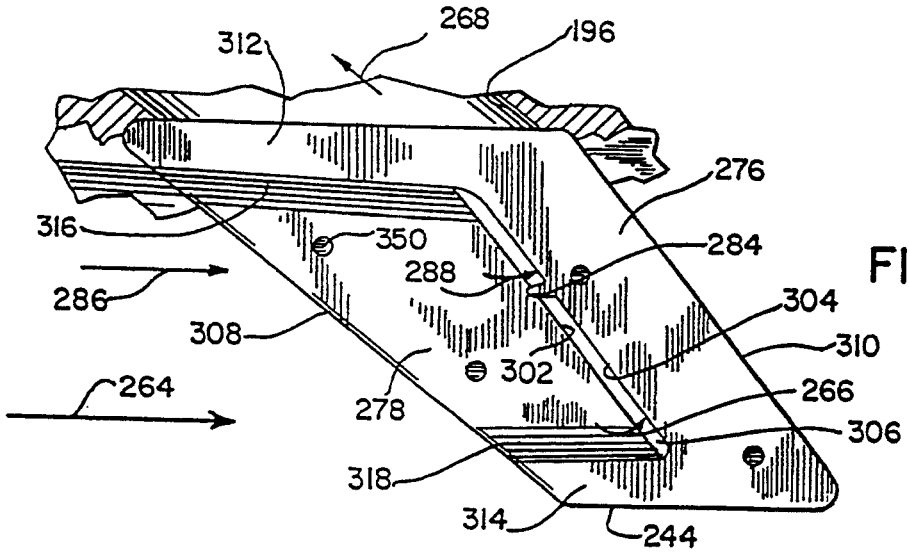
FIG. 10 is a view partly in section taken along line 10—10 of FIG. 7.
Figure 15:
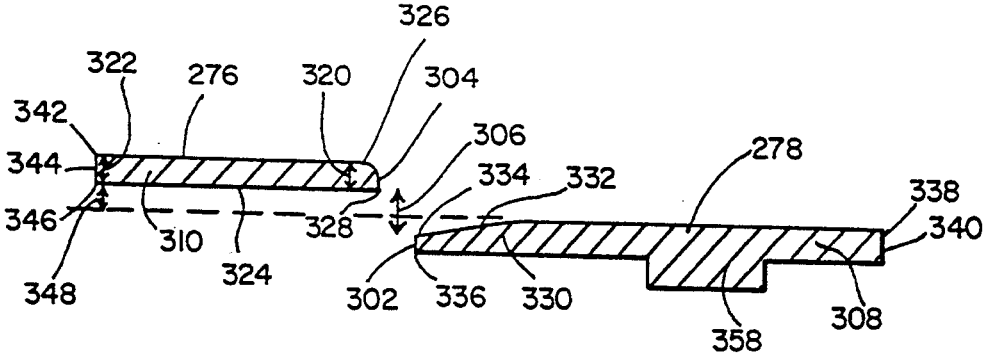
FIG. 15 is a sectional view taken along line 15—15 of FIG. 9.

Forward ramp surface 278, FIGS. 10 and 15, of left water inlet plate 244 has a rearward trailing edge 302 in water inlet opening 240 and spaced inwardly of forward leading edge 304 of aft outer surface 276 by a transverse gap 306 therebetween. Gap 306 controls water intake flow volume into water inlet opening 240. As shown in FIG. 10, forward leading edge 304 of aft outer surface 276 and rearward trailing edge 302 of forward ramp surface 278 are parallel to each other and extend diagonally relative to horizontal, and substantially along the direction of water flow 268 through internal water passage 196 of the skeg. Rearward trailing edge 302 of forward ramp surface 278 is spaced inwardly and forwardly of forward leading edge 304 of aft outer surface 276.

The noted aft upper inner boss portion 292 of left water inlet plate 244 also provides a spacing strut extending between forward leading edge 304 of aft outer surface 276 and rearward trailing edge 302 of forward ramp surface 278, and maintains gap 306 at a given width. The strut provided by boss 292 has the noted leading edge 284 forming the noted flow divider. The strut provided by boss 292 has a rearward portion aft of flow divider 284 and has the noted curved radiused surface 290 forming the noted upper turning vane guiding the upper water stream flow from initial path 286 along curved second path 288. Left water inlet plate 244 has the noted aft lower boss 272 spaced below and rearwardly of strut boss 292 and extending inwardly from the water inlet plate aft of forward leading edge 304, and including the noted curved radiused surface 262 providing the noted lower turning vane guiding the lower stream water flow from initial path 264 along curved second path 266. The right water inlet plate is comparable.

Figure 9:
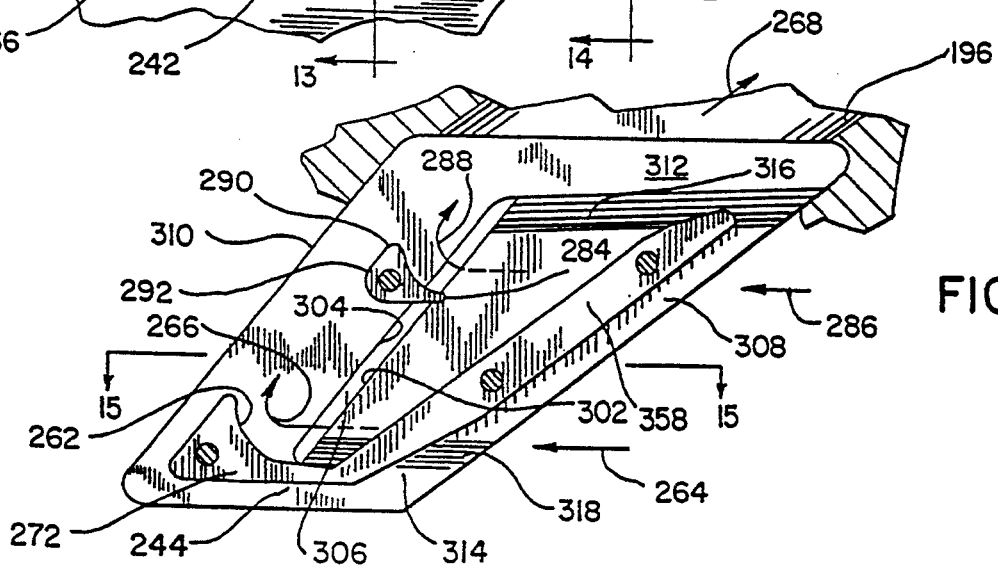
FIG. 9 is a view partly in section taken along line 9—9 of FIG. 7.

The noted forward ramp surface 278 and aft outer surface 276 of left water inlet plate 244 are provided along fore and aft plate sidewalls 308 and 310, FIGS. 15, 10 and 9. Water inlet plate 244 has an upper plate sidewall 312, FIGS. 9 and 10, extending forwardly from aft plate sidewall 310 above forward plate sidewall 308. Water inlet plate 244 has a lower plate sidewall 314 extending forwardly from aft plate sidewall 310 below forward plate sidewall 308. Water inlet plate 244 has an upper transition sidewall 316 extending inwardly and downwardly from upper plate sidewall 312 to forward plate sidewall 308. Water inlet plate 244 has a lower transition sidewall 318 extending inwardly and upwardly from lower plate sidewall 314 to forward plate sidewall 308. Upper plate sidewall 312 has a greater fore-to-aft length than lower plate sidewall 314, FIG. 10. Right water inlet plate 242 is comparable.

Aft plate sidewall 310, FIG. 15, has increasing cross-sectional widths fore-to-aft such that the cross-sectional width 320 at the front of aft plate sidewall 310 is less than the cross-sectional width 322 at the rear of aft plate sidewall 310. Aft plate sidewall 310 is tapered along its inner surface 324 to provide the noted increasing cross-sectional widths fore-to-aft. Aft plate sidewall 310 has the noted forward leading edge 304 with outer and inner corners 326 and 328. Inner corner 328 is sharp, and outer corner 326 is rounded. Forward plate sidewall 308 has a rearward segment 330 which is tapered along its outer surface at 332 to provide decreasing cross-sectional widths fore-to-aft. Rearward trailing edge 302 of fore plate sidewall 308 has outer and inner corners 334 and 336, each of which is sharp. The tapers along surfaces 324 and 332 are preferred to maximize the width of lateral gap 306 and provide sufficient cooling water flow volume. This reduces the lateral widths of trailing edge 302 and leading edge 304 which in turn reduces the strength thereof and may subject such edges to warping or other movement under high water pressure. The support struts provided by bosses 292 and 294 at leading edges and flow dividers 284 and 285, respectively, prevent such movement and maintain uniform lateral width of gap 306. In the preferred embodiment, there is about 40 lbs. per square inch water pressure into the water inlet, and about 9 lbs. per square inch at the outlet of water passage 196 in the skeg going into torpedo nose passage 198. In the preferred embodiment, the water intake rate is about 30 gallons per minute, with the water pump on the engine pulling about 15 gallons per minute, and the balance provided by ram pressure. Corners 334 and 328 are preferably sharp to provide sharp break-off of water therepast and into the water inlet opening, with minimum creeping of water around such corner or edge. Corner 326 is preferably rounded to minimize turbulence and drag.

Outer corner 338 of leading edge 340 of fore plate sidewall 308 is flush with the skeg sidewall. Outer corner 342 of trailing edge 344 of aft plate sidewall 310 is flush with the skeg sidewall. Inner corner 346 of trailing edge 344 of aft plate sidewall 310 is spaced laterally outwardly of corner 338 by a lateral gap 348 having a width less than that of gap 306 between corners 328 and 334.

Left water inlet plate 244 has a fore upper mounting hole 350, FIGS. 6 and 10, in fore plate sidewall 308, a fore lower mounting hole 352 in fore plate sidewall 308, an aft upper mounting hole 354 in aft plate sidewall 310, and an aft lower mounting hole 356 in aft plate sidewall 310. Mounting holes 354 and 356 are provided through respective bosses 292 and 272, providing increased stock thickness for rigidity and support. Mounting holes 350 and 352 are provided through fore upper and lower bosses formed as increased thickness sidewall sections extending inwardly from fore plate sidewall 308, and preferably formed as a single elongated boss 358 for added strength and ease of forming. Right water inlet plate 242 is comparable. The plates are mounted to each other by mounting bolts 360, 362, 364, 366 extending through mounting holes 368, 370, 372, 374 in water inlet plate 242 and threaded into mounting holes 350, 352, 354, 356 in mounting plate 244. The fore upper boss portion 376, FIG. 11, of plate 244 extends inwardly into water inlet opening 240 and abuts the fore upper boss portion 378 of plate 242 at interface 380. Likewise, the remaining bosses extend inwardly into the water inlet opening and abut the boss of the other water inlet plate.

It is recognized that various equivalents, alternatives and modifications are possible within the scope of the appended claims.

We claim:

1. A marine drive for propelling a boat comprising a housing having a lower torpedo and a skeg extending downwardly from said torpedo, said skeg having a sidewall with a water inlet opening therein, said skeg having an internal water passage extending upwardly from said water inlet opening, a water inlet plate covering said water inlet opening, said plate having a flow divider separating incoming water flow entering said water inlet opening into separate upper and lower water streams each initially flowing along a first path horizontally rearwardly and then along a second curved path and then along a third path upwardly in said internal water passage, upper and lower turning vanes each comprising a curved radiused surface guiding the respective said stream along said second path.

2. The invention according to claim 1 wherein said upper turning vane has a forward leading edge providing said flow divider.

3. The invention according to claim 1 wherein said upper vane is spaced from said lower vane along the direction of said third path.

4. The invention according to claim 1 wherein said lower water stream flows along said second curved path along said lower turning vane and then flows upwardly along said third path aft of said upper turning vane and then merges with said upper water stream above said upper turning vane.

5. A marine drive for propelling a boat comprising a housing having a lower torpedo and a skeg extending downwardly from said torpedo, said skeg having a sidewall with a water inlet opening therein, said skeg having an internal water passage extending upwardly from said water inlet opening, a water inlet plate covering said water inlet opening, said plate having an aft outer surface with a forward leading edge, said plate having a forward ramp surface extending rearwardly and inwardly from a forward leading edge to a rearward trailing edge in said water inlet opening, said rearward trailing edge being spaced inwardly of said forward leading edge of said aft outer surface by a transverse gap therebetween, which gap controls water intake flow volume into said water inlet opening.

6. The invention according to claim 5 wherein said forward leading edge of said aft outer surface and said rearward trailing edge of said forward ramp surface extend diagonally relative to horizontal.

7. The invention according to claim 6 wherein said internal water passage in said skeg extends forwardly and upwardly from said water intake opening, and wherein said forward leading edge of said aft outer surface and said rearward trailing edge of said forward ramp surface lie substantially along the direction of water flow through said internal water passage in said skeg.

8. The invention according to claim 7 wherein said forward leading edge of said aft outer surface and said rearward trailing edge of said forward ramp surface are parallel to each other.

9. The invention according to claim 5 wherein said rearward trailing edge of said forward ramp surface is spaced inwardly and forwardly of said forward leading edge of said aft outer surface.

10. The invention according to claim 5 comprising a spacing strut extending between said forward leading edge of said aft outer surface and said rearward trailing edge of said forward ramp surface and maintaining said gap at a given width.

11. The invention according to claim 10 wherein said strut has a leading edge forming a flow divider separating water flow entering said water inlet opening into separate upper and lower streams each flowing along a first path horizontally rearwardly and then along a second curved path and then along a third path upwardly in said internal water passage.

12. The invention according to claim 5 wherein said forward ramp surface and said aft outer surface of said water inlet plate are provided along fore and aft plate sidewalls, and wherein said water inlet plate has an upper plate sidewall extending forwardly from said aft plate sidewall above said fore plate sidewall, a lower plate sidewall extending forwardly from said aft plate sidewall below said fore plate sidewall, an upper transition sidewall extending inwardly and downwardly from said upper plate sidewall to said fore plate sidewall, and a lower transition sidewall extending inwardly and upwardly from said lower plate sidewall to said fore plate sidewall.

13. The invention according to claim 12 wherein said aft plate sidewall has increasing cross-sectional widths fore to aft such that the cross-sectional width at the front of said aft plate sidewall is less than the cross-sectional width at the rear of said aft plate sidewall.

14. The invention according to claim 13 wherein said aft plate sidewall is tapered along its inner surface to provide said increasing cross-sectional widths.

15. The invention according to claim 12 wherein said aft plate sidewall has a forward leading edge with inner and outer corners, said inner corner being sharp, said outer corner being rounded.

16. The invention according to claim 12 wherein said fore plate sidewall has a rearward segment which is tapered along its outer surface to provide decreasing cross-sectional widths fore to aft.

17. The invention according to claim 16 wherein said fore plate sidewall has a rearward trailing edge with inner and outer corners, each of said inner and outer corners being sharp.

18. The invention according to claim 12 wherein said aft plate sidewall has a rearward trailing edge with an inner corner spaced laterally outwardly of the outer corner of the forward leading edge of said fore plate sidewall by a first lateral gap, said aft plate sidewall has a forward leading edge with an inner corner spaced laterally outwardly of the outer corner of the rearward trailing edge of said fore plate sidewall by a second lateral gap, wherein said first lateral gap is less than said second lateral gap.

19. The invention according to claim 12 wherein said upper plate sidewall has a greater fore to aft length than said lower plate sidewall.

20. A marine drive for propelling a boat comprising a housing having a lower torpedo and a skeg extending downwardly from said torpedo, said skeg having a sidewall with a water inlet opening therein, said skeg having an internal water passage extending upwardly from said water inlet opening, a water inlet plate covering said water inlet opening, said plate having an aft outer surface with a forward leading edge, said plate having a forward ramp surface with a rearward trailing edge in said water inlet opening and spaced inwardly of said forward leading edge of said aft outer surface by a transverse gap therebetween, which gap controls water intake flow volume into said water inlet opening, comprising a spacing strut extending between said forward leading edge of said aft outer surface and said rearward trailing edge of said forward ramp surface and maintaining said gap at a given width, wherein said strut has a leading edge forming a flow divider separating water flow entering said water inlet opening into separate upper and lower streams each flowing along a first path horizontally rearwardly and then along a second curved path and then along a third path upwardly in said internal water passage, said strut has a rearward portion with a curved radiused surface forming a turning vane guiding said upper stream water flow along said second path.

21. The invention according to claim 20 comprising a second turning vane spaced below and rearwardly of said strut and extending inwardly from said outer surface of said water inlet plate and aft of said forward leading edge of said outer surface of said water inlet plate, said second turning vane comprising a curved radiused surface guiding said lower stream water flow along said second path.

22. A marine drive for propelling a boat comprising a housing having a lower torpedo and a skeg extending downwardly from said torpedo, said skeg having a sidewall with a water inlet opening therein, said skeg having an internal water passage extending upwardly from said water inlet opening, a water inlet plate covering said water inlet opening, said plate having an aft outer surface with a forward leading edge, said plate having a forward ramp surface with a rearward trailing edge in said water inlet opening and spaced inwardly of said forward leading edge of said aft outer surface by a transverse gap therebetween, which gap controls water intake flow volume into said water inlet opening, wherein said forward ramp surface and said aft outer surface of said water inlet plate are provided along fore and aft plate sidewalls, and wherein said water inlet plate has an upper plate sidewall extending forwardly from said aft plate sidewall above said fore plate sidewall, a lower plate sidewall extending forwardly from said aft plate sidewall below said fore plate sidewall, an upper transition sidewall extending inwardly and downwardly from said upper plate sidewall to said fore plate sidewall, and a lower transition sidewall extending inwardly and upwardly from said lower plate sidewall to said fore plate sidewall, a pair of said water inlet plates each comprising a fore upper mounting hole in said fore plate sidewall, a fore lower mounting hole in said fore plate sidewall, an aft upper mounting hole in said aft plate sidewall, an aft lower mounting hole in said aft plate sidewall, a fore upper boss formed as an increased thickness sidewall section extending inwardly from the inner surface of said fore plate sidewall at said fore upper mounting hole, a fore lower boss formed as an increased thickness sidewall section extending inwardly from the inner surface of said fore plate sidewall at said fore lower mounting hole, an aft upper boss formed as an increased thickness sidewall section extending inwardly from the inner surface of said aft plate sidewall at said aft upper mounting hole, an aft lower boss formed as an increased thickness sidewall section extending inwardly from the inner surface of said aft plate sidewall at said aft lower mounting hole.

23. The invention according to claim 22 wherein said fore upper boss extends inwardly into said water inlet opening and abuts the fore upper boss of the other water inlet plate, said fore lower boss extends inwardly into said water inlet opening and abuts the fore lower boss of the other water inlet plate, said aft upper boss extends inwardly into said water inlet opening and abuts the aft upper boss of the other water inlet plate, said aft lower boss extends inwardly into said water inlet opening and abuts the aft lower boss of the other water inlet plate.

24. The invention according to claim 22 wherein said aft upper boss of each said water inlet plate has a forward leading edge providing a flow divider separating incoming water flow entering said water inlet opening into separate upper and lower water streams each initially flowing along a first path horizontally rearwardly and then along a second curved path and then along a third path upwardly in said internal water passage.

25. The invention according to claim 24 wherein said aft upper boss and said aft lower boss of each said water inlet plate comprises a turning vane surface above the respective said mounting hole and receiving incoming water flow along said first path and turning said water flow along said second path and directing said water flow along said third path.

* * * * *